US006722923B2

(12) United States Patent
Huang

(10) Patent No.: US 6,722,923 B2
(45) Date of Patent: Apr. 20, 2004

(54) ELECTRICAL CONNECTOR WITH SECURELY ASSEMBLED SPACER

(75) Inventor: Chieh-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/288,085

(22) Filed: Nov. 4, 2002

(65) Prior Publication Data

US 2003/0232538 A1 Dec. 18, 2003

(30) Foreign Application Priority Data

Jun. 13, 2002 (TW) ..... 91208813 U

(51) Int. Cl.[7] ..... H01R 13/648
(52) U.S. Cl. ..... 439/607; 439/79
(58) Field of Search ..... 439/79, 80, 607, 439/608, 892, 65

(56) References Cited

U.S. PATENT DOCUMENTS 5,382,168 A * 1/1995 Azuma et al. ..... 439/65
5,540,598 A * 7/1996 Davis ..... 439/79
5,643,010 A 7/1997 Wu
5,658,156 A 8/1997 Henderson et al.
5,709,556 A 1/1998 Tan et al.
5,711,678 A 1/1998 Wu
5,879,171 A 3/1999 Wu
6,056,560 A * 5/2000 Wu et al. ..... 439/607
6,146,201 A 11/2000 Chen
6,273,732 B1 * 8/2001 Johnescu et al. ..... 439/79
6,375,498 B1 * 4/2002 Yu et al. ..... 439/607

OTHER PUBLICATIONS

"Docking Connectors Simplify Drive Designs", Connector Specifier, issued on Mar., 2000.

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

An electrical connector includes a housing (1), conductive terminals (3) retained in the housing, a shielding shell (2) assembled onto the housing, and a spacer (5) defining positioning holes (51) for retaining tail ends of the terminals in position. The housing has two pairs of guiding posts (14) and the spacer has a pair of hollow posts (54) extending upwardly at each elongated end thereof for cooperating with a corresponding pair of the guiding posts of the housing. The spacer is assembled onto the housing by the engagement between the guiding posts and the hollow posts. Each guiding post defines a circumferential recess (141) in the periphery (140) thereof. Each hollow post has a loop-shaped protrusion (541) formed on an inner side thereof. Each guiding post is received in a corresponding hollow post by the engagement between the protrusion and the recess.

3 Claims, 6 Drawing Sheets

ELECTRICAL CONNECTOR WITH SECURELY ASSEMBLED SPACER

BACKGROUND OF THE INVENTION

1. Field of the Invention

The present invention is related to an electrical connector, and more particularly to an electrical connector having a spacer for positioning tails of a plurality of terminals thereof.

2. Description of Related Art

With the rapid development of the consumer and commercial products, hard disk drivers are not only used in personal computers but also widely used in other products such as set-top boxes, fax machines, network processors and video recorders etc. The hard disk drivers for use with these products are required to increase data storage capacity and transfer rates. Consequently, it is necessary to provide a new connection interface. An article, entitled "Docking Connectors Simplify Drive Designs" and published in a monthly periodical entitled "CONNECTOR SPECIFIER" issued on March, 2000, discloses several docking connectors. The docking connectors can be directly mounted on a printed circuit board without using a flat ribbon cable or a power wire harness.

A conventional docking connector usually comprises an elongated insulative housing, a plurality of terminals, a metal shielding shell and a spacer. The insulative housing defines a plurality of receiving passageways therethrough for receiving the terminals. The tails of the terminals extend beyond the insulative housing. The shielding shell is assembled onto the insulative housing for shielding mating portions of the terminals. The spacer has two clasping arms upwardly extending therefrom and each clasping arm has a hook at a top end thereof. The hooks engage corresponding recesses of the insulative housing for assembling the spacer onto the insulative housing. The spacer defines a plurality of holes and the tails of the terminals pass through the holes for retaining in proper positions. For example, U.S. Pat. Nos. 5,643,010, 5,658,156, 5,709,556, 5,711,678, 5,879,171 and 6,146,201 all disclose such a connector. However, the conventional engagement between the hooks and the recesses is not stable. When the clasping arms are subject to a lateral force, it is easy for the hooks to break away from the recesses.

Hence, it is requisite to provide an improved electrical connector to overcome the above-mentioned disadvantages.

SUMMARY OF THE INVENTION

Accordingly, the main object of the present invention is to provide an electrical connector with a spacer stably and reliably assembled thereto.

In order to achieve the object set forth, an electrical connector in accordance with the present invention comprises an insulative housing defining a plurality of passageways, a plurality of conductive terminals, a metal shielding shell assembled onto the insulative housing and a spacer. One ends of the conductive terminals are received in the passageways of the insulative housing and the other ends thereof extend beyond the insulative housing. The space defines a plurality of positioning holes for retaining the other ends of the conductive terminals in position. The spacer is mounted onto the insulative housing by means of the engagement between a plurality of guiding posts and hollow posts. The guiding posts are formed on one of the spacer and the insulative housing, and the hollow posts are formed in the other of the spacer and the insulative housing. Each guiding post is received in a corresponding hollow post by means of the engagement between a protrusion and a recess. The protrusion is formed on one of the periphery of the guiding post and an inner side of the hollow post, and the recess is defined in the other of the periphery of the guiding post and the inner side of the hollow post.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
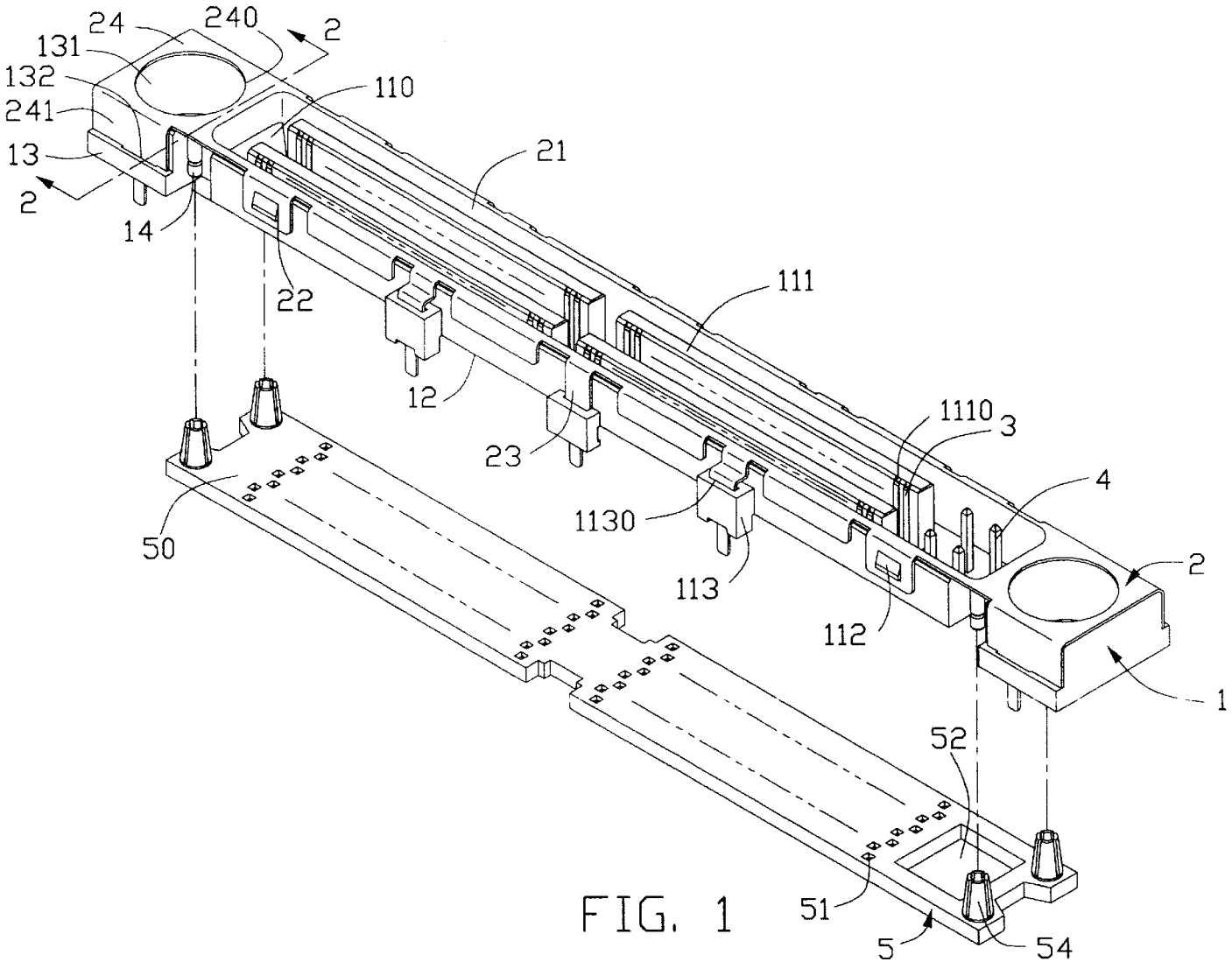
FIG. 1 is an exploded, perspective view of an electrical connector in accordance with the present invention.
Figure 2:
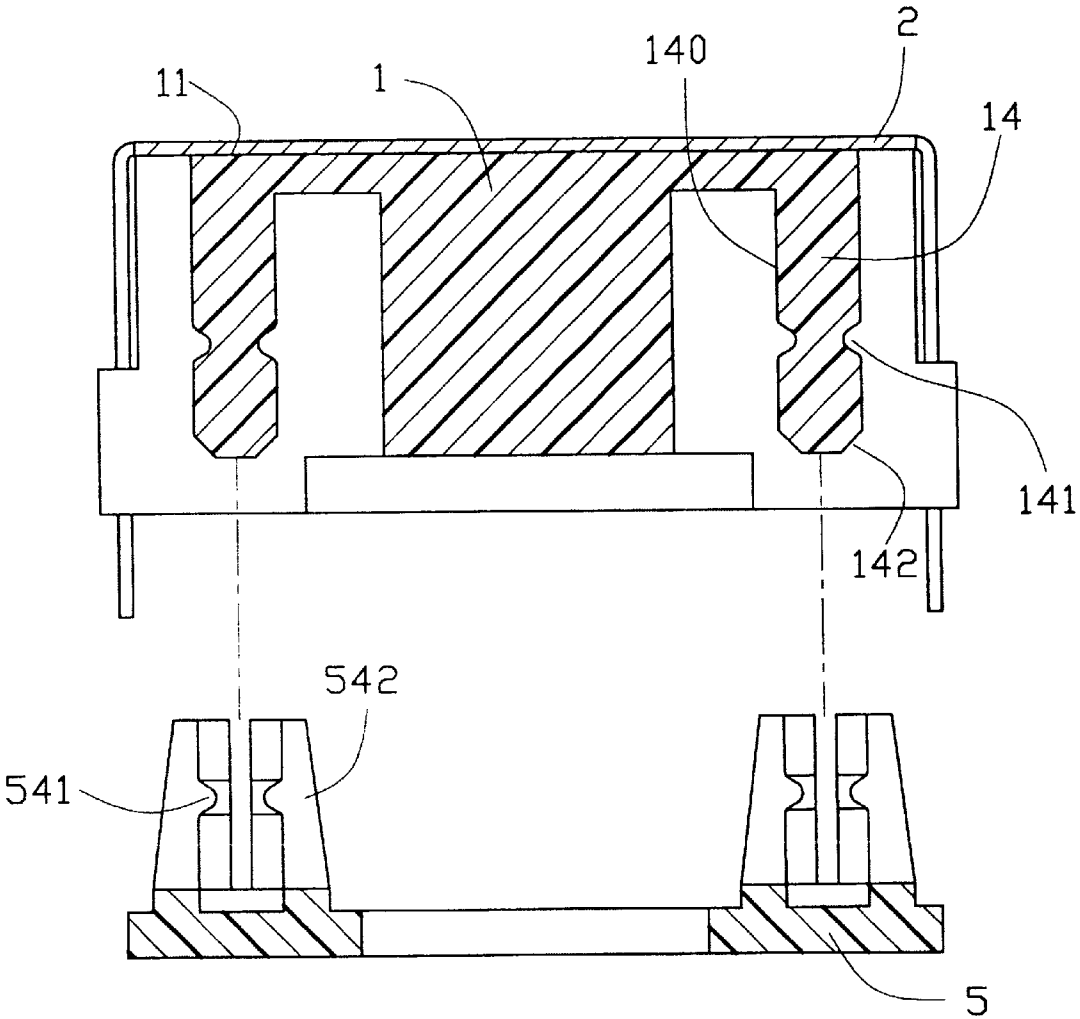
FIG. 2 is a cross-sectional view of the electrical connector taken along line 2—2 of FIG. 1.
Figure 3:
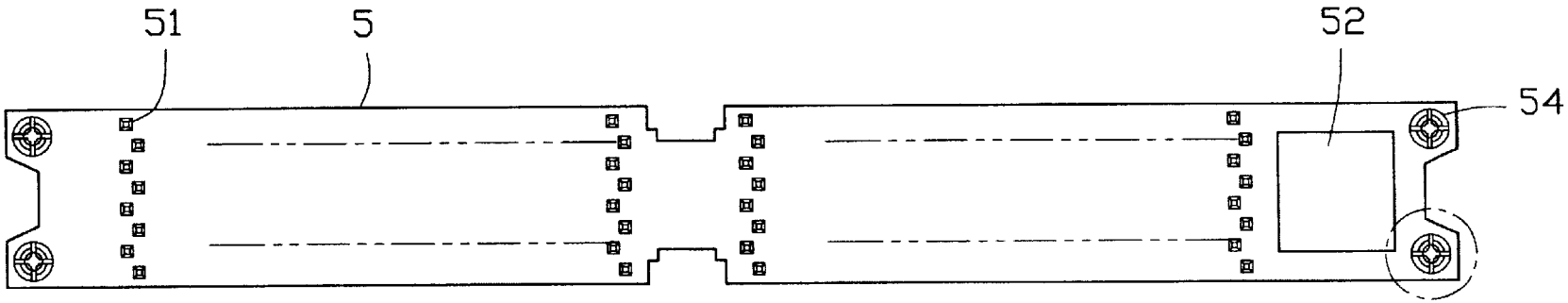
FIG. 3 is a top plan view of a spacer of the electrical connector of FIG. 1.
Figure 4:
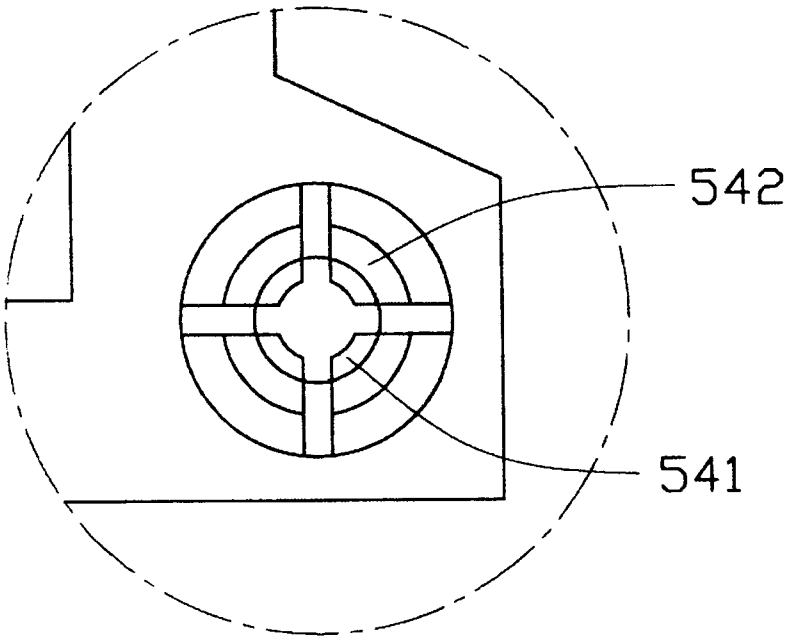
FIG. 4 is an enlarged view of a circled area of the spacer shown in FIG. 3.
Figure 5:
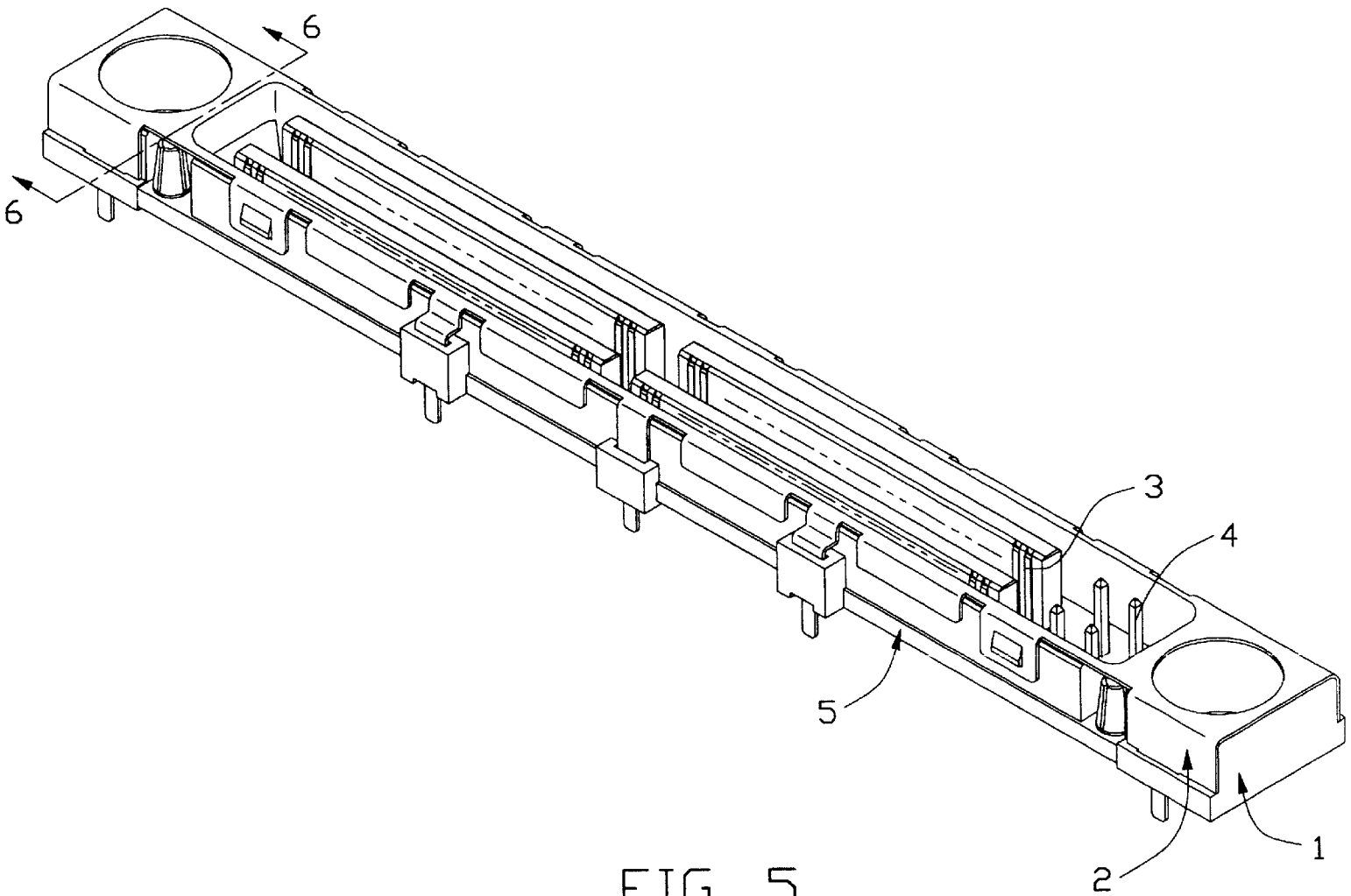
FIG. 5 is an assembled view of the electrical connector of FIG. 1.
Figure 6:
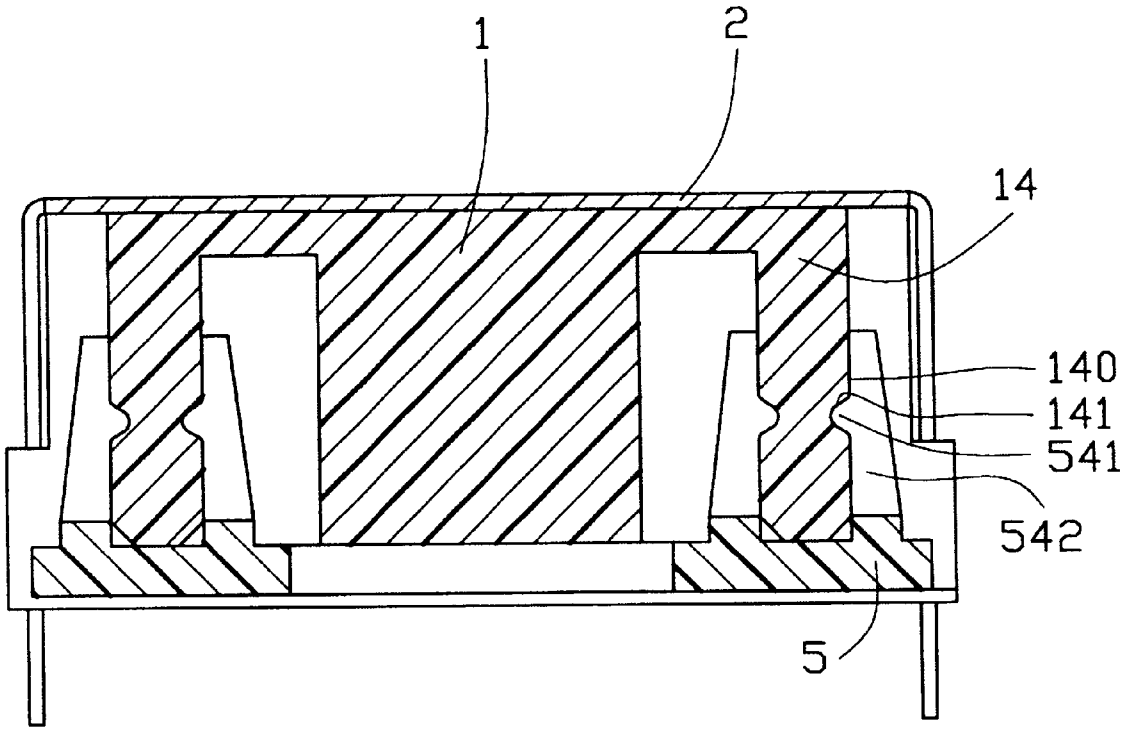
FIG. 6 is a cross-sectional view of the electrical connector taken along line 6—6 of FIG. 5.

Referring to FIGS. 1 and 2, an electrical connector in accordance with the present invention comprises an insulative housing 1, a metal shielding shell 2 mounted on the insulative housing 1, signal terminals 3, power terminals 4 and a spacer 5.

The insulative housing 1 has an elongated configuration. The top surface of the insulative housing 1 is a mating surface 11 and a lower surface opposite to the top surface is an engaging surface 12. The mating surface 11 defines a mating cavity 110 and four mating tongues 111 arranged in two rows are provided in the mating cavity 110. Each mating tongue 111 defines in opposite side surfaces a plurality of passageways 1110 extending downwardly through the insulative housing 1. Upper ends of the signal terminals 3 are received in the passageways 1110 for electrically mating with corresponding terminals of a mating connector (not shown). Lower ends of the signal terminals 3 extend beyond the engaging surface 12 of the insulative housing 1 for soldering to a printed circuit board (not shown). The power terminals 4 are not received in the passageways 1110 but partially located at one end of the mating cavity 110 and then downwardly extend beyond the engaging surface 12 of the insulative housing 1. A plurality of embossments 112 and retentive projections 113 is formed on opposite side walls of the insulative housing 1. Each retentive projection 113 has a retentive groove 1130. The two ends of the insulative housing 1 respectively and symmetrically have a pair of supporting sections 13 integrally molded therewith. Each supporting section 13 defines a hole 131 for receiving a guiding portion of the mating connector and a pair of retentive slits 132 on opposite lateral sides of the holes 131. The insulative housing 1 further has two pairs of guiding posts 14 extending toward the engaging surface 12 at locations proximate to the mating cavity 110 and the supporting sections 13. Each guiding post 14 defines a circumferential recess 141 in the periphery 140 thereof and forms a chamfer 142 at the free end thereof.

The shielding shell 2 defines a shielding slot 21 corresponding to the mating cavity 110 of the insulative housing 1. The shielding shell 2 is attached to the insulative housing 1 for achieving the purpose of electromagnetic shielding. The shielding shell 2 defines a plurality of clasping holes 22 in opposite side walls thereof for receiving the embossments 112 of the insulative housing 1. The side walls of the shielding shell 2 further define a plurality of retentive sections 23 for being received in the retentive grooves 1130 of the retentive projections 113. The shielding shell 2 further has two cooperating pieces 24 at opposite ends of the shielding slot 21 corresponding to the supporting sections 13 of the insulative housing 1. Each cooperating piece 24 defines a cooperating hole 240 corresponding to the hole 131 of the supporting section 13 of the insulative housing 1. The cooperating piece 24 has two retentive pieces 241 extending downwardly from opposite sides thereof for being received in the retentive slits 132 of the supporting section 13.

Referring to FIGS. 1, 3, 4 and 5, the spacer 5 has an elongated panel 50. The elongated panel 50 defines a plurality of positioning holes 51 for positioning soldering tails (not shown) of the signal terminals 3 and a rectangular hole 52 for allowing soldering tails (not shown) of the power terminals 4 to downwardly extend therethrough. A pair of hollow posts 54 is provided at each elongated end of the elongated panel 50 and extends upwardly for cooperating with a corresponding pair of the guiding posts 14 of the insulative housing 1. Each hollow post 54 has a loop-shaped protrusion 541 formed on an inner side thereof, and is vertically quadrisected into four elastic arms 542 along two axes perpendicular to each other. When the spacer 5 is assembled onto the insulative housing 1, the guiding posts 14 of the insulative housing 1 are inserted into the hollow posts 54. The chamfers 142 at the free ends of the guiding posts 14 guide the guiding posts 14 into the hollow posts 54 to a predetermined position and reduce the insertion force when passing through the protrusions 541 of the hollow posts 54. When the guiding posts 14 are wholly received in the hollow posts 54, the protrusions 541 on the inner side of the hollow posts 54 are engaged with the recesses 141 in the peripheries 140 of the guiding posts 14. Simultaneously, the four elastic arms 542 of the hollow posts 54 exert retentive forces on the periphery 140 of the guiding post 14 in directions towards the axis of the guiding post 14. Therefore, the spacer 5 is reliably fixed in the insulative housing 1 and disengagement therebetween is effectively prevented even when a lateral force acts on the spacer 5.

It should be noted that, the guiding post 14 can be disposed on one of the spacer 5 and the insulative housing 1, and the hollow post 54 for receiving the guiding post 14 can be correspondingly disposed on the other. Additionally, the protrusion 541 can be disposed on one of the periphery 140 of the guiding post 14 and the inner side wall of the hollow post 54, and the recess 141 for receiving the protrusion 541 can be correspondingly disposed on the other. These modifications can also achieve the same effect as the preferred embodiment described above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a plurality of passageways;

a plurality of conductive terminals having one ends thereof received in the passageways of the insulative housing and the other ends thereof extending beyond the insulative housing;

a metal shielding shell assembled onto the insulative housing; and a spacer defining a plurality of positioning holes for retaining the other ends of the conductive terminals in position;

wherein the spacer is mounted onto the insulative housing by means of the engagement between a plurality of guiding posts and hollow posts, each hollow post being divided into plural elastic arms, the guiding posts being formed on one of the insulative housing and the spacer, and the hollow posts being formed on the other of the insulative housing and the spacer, each guiding post being received in a corresponding hollow post by means of the engagement between a protrusion and a recess, the protrusion being formed on one of the periphery of the guiding post and an inner side of the hollow post, and the recess being defined in the other of the periphery of the guiding post and the inner side of the hollow post; wherein the insulative housing comprising a mating surface and a plurality of mating tongues, the mating surface defining inwardly a mating cavity, the mating tongues being received in the mating cavity and arranged in two rows, and said passageways are defined in opposite side surfaces of the mating tongues; wherein the insulative housing comprises a pair of supporting sections respectively and symmetrically formed on opposite ends thereof, each supporting section defining a bole adapted for receiving a corresponding guiding portion of a mating connector; wherein said guiding post is formed between the mating cavity and a corresponding supporting section of the insulative housing; wherein said recess is a circumferential recess formed in the periphery of the guiding post, and said protrusion is a loop-shaped protrusion formed on the inner side of the hollow post; wherein each guiding post forms a chamfer at the free end thereof; wherein each hollow post is vertically quadrisected into four elastic arms along two axes perpendicular to each other.

2. The electrical connector as claimed in claim 1, wherein the shielding shell comprises a shielding slot corresponding to the mating cavity of the insulative housing, and two cooperating pieces at opposite respective ends of the shielding slot for engaging corresponding supporting sections of the insulative housing, each cooperating piece defining a cooperating hole corresponding to the hole of the supporting section of the insulative housing.

3. The electrical connector as claimed in claim 2, further comprising plural power terminals partially located at one end of the mating cavity and then downwardly extending beyond the insulating housing, and the spacer defines a rectangular hole for allowing soldering tails of the power terminals to downwardly extend therethrough.

* * * * *